US008246750B2

(12) United States Patent
Shin et al.

(10) Patent No.: US 8,246,750 B2
(45) Date of Patent: Aug. 21, 2012

(54) APPARATUS AND METHOD FOR HYDROLYSIS OF CELLULOSIC MATERIAL IN A MULTI-STEP PROCESS TO PRODUCE $C_5$ AND $C_6$ SUGARS USING A SINGLE VESSEL

(75) Inventors: Namhee Shin, Clifton Park, NY (US); C. Bertil Stromberg, Diamond Point, NY (US); Thomas Pschorn, Quebec (CA)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 13/204,893

(22) Filed: Aug. 8, 2011

(65) Prior Publication Data

US 2011/0303217 A1 Dec. 15, 2011

Related U.S. Application Data

(62) Division of application No. 12/478,353, filed on Jun. 4, 2009.

(60) Provisional application No. 61/060,299, filed on Jun. 10, 2008.

(51) Int. Cl.
*C13B 20/00* (2011.01)
*C13B 10/14* (2011.01)
*C13B 35/06* (2011.01)

(52) U.S. Cl. ..... 127/46.1; 127/9; 127/44

(58) Field of Classification Search ..... None
See application file for complete search history.

(56) References Cited

U.S. PATENT DOCUMENTS

| | | | |
|---|---|---|---|
| 3,380,883 | A | 4/1968 | Richter et al. |
| 3,413,189 | A | 11/1968 | Backlund |
| 2008/0295981 | A1 | 12/2008 | Shin et al. |
| 2008/0302492 | A1 | 12/2008 | Shin et al. |

FOREIGN PATENT DOCUMENTS

WO 2007/051269 5/2007

OTHER PUBLICATIONS

U.S. Appl. No. 12/478,335, of Namhee Shin et al., filed Jun. 4, 2009.

*Primary Examiner* — Emily Le
*Assistant Examiner* — Sarah A Slifka
(74) *Attorney, Agent, or Firm* — Nixon & Vanderhye P.C.

(57) ABSTRACT

A system and method for extracting $C_5$ sugars including pentose and/or $C_6$ sugars including hexose from a slurry of cellulosic material comprising cellulose, water, and optionally acid.

7 Claims, 1 Drawing Sheet

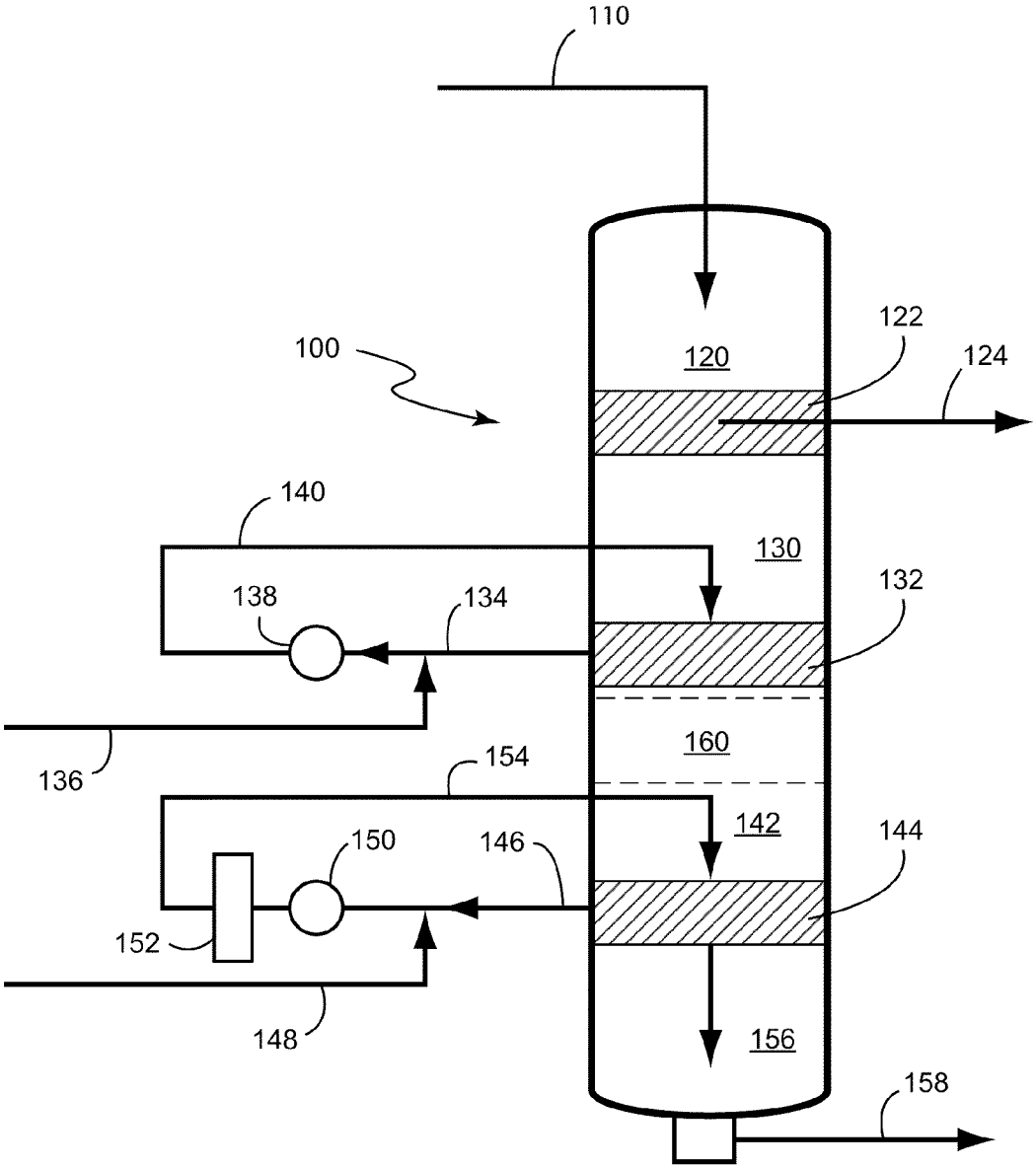
110
100
120
122
124
140
130
138
134
132
136
160
154
142
150
146
144
152
148
156
158

APPARATUS AND METHOD FOR HYDROLYSIS OF CELLULOSIC MATERIAL IN A MULTI-STEP PROCESS TO PRODUCE $C_5$ AND $C_6$ SUGARS USING A SINGLE VESSEL

RELATED APPLICATION

This application is a divisional of U.S. patent application Ser. No. 12/478,353, filed Jun. 4, 2009, that application claims the benefit of priority to U.S. Provisional Patent Application No. 61/060,299 filed Jun. 10, 2008, the entire contents of both of which is incorporated by reference herein.

BACKGROUND OF THE INVENTION

This invention relates to a method and an apparatus for hydrolysis treatment of cellulosic fiber material.

In conventional systems, wood chips (or other cellulosic or fiber material) can undergo hydrolysis in a single vessel prior to treatment or cooking in a digester, such as described in U.S. Pat. Nos. 3,380,883 and 3,413,189. In such systems, hydrolysis occurs under acidic conditions in the slurry of wood chips, e.g., cellulosic material, passing through a top section of the vessel with the continued treatment of cooking in lower sections of the vessel followed by washing in the bottom of the vessel. In the upper region of the vessel, hydrolysate, e.g., $C_5$ and $C_6$ sugars such as pentose and hexose and other hemicellulose, is extracted from wood chips and the hydrolysate is recovered.

Hydrolysis occurs throughout the upper region of the vessel by the introduction of steam, acid and/or water in a concurrent flow in the upper region. In the lower region of the vessel, the cellulosic material is cooked and washed and is subsequently discharged as pulp from the vessel.

It is generally believed that performing the hydrolysis at a high temperature may produce the greatest volume of desired sugars. But high temperature treatment of wood or other cellulosic material may cause operational problems for the reaction vessel. For example, the treatment (hydrolysis) of cellulosic material at temperatures over 170° C. may cause the lignin to dissolve and may lead to an accumulation of the lignin in the vessel, especially on the internal surfaces. To avoid this lignin dissolving and accumulation in the vessel, the vessels may be operated at lower temperatures and for longer time. This may require a larger vessel resulting in a higher capital investment.

Other methods of hydrolyzing cellulosic material are described in U.S. application Ser. Nos. 12/114,856 (U.S. Pat. App. Pub. No. 2008/0302492) and 12/114,881 (U.S. Pat. App. Pub. No. 2008/0295981).

In certain aspects, the present invention may relate to hydrolyzing cellulosic material while minimizing any undesirable effects with respect to lignin (e.g., accumulation within the reaction vessel).

BRIEF DESCRIPTION OF THE INVENTION

The purpose of the invention is to dissolve the vast majority of hemicellulose and the majority of the cellulose present in the feed material, thereby chemically disintegrating the structure of the lignin cellulosic feed stock particles, such that the material will form a soup-like material.

In an aspect, an embodiment generally relates to an apparatus for extracting $C_5$ (pentose) and/or $C_6$ (hexose) from a slurry of cellulosic material comprising cellulose, water, and optionally acid, the apparatus comprising (i) an inlet adapted to receive the slurry at a top of a vessel; (ii) a first stage in which the slurry is exposed to a temperature between 130° C. and 190° C. for a period of time ranging between 10 minutes and 120 minutes, (iii) a first extraction screen and line that remove liquid containing $C_5$ (pentose) and/or $C_6$ (hexose and hemicellulose) from the slurry, (iv) a counter-current wash zone in which the slurry is exposed to a temperature between 100° C. and 170° C. for a period of time ranging between 30 minutes and 120 minutes, wherein the counter-current wash zone includes a first recycle loop in which water may be added to the slurry; (v) a second stage in which the slurry is exposed to a temperature between 150° C. and 190° C. for a period of time ranging between 30 minutes and 240 minutes, wherein the liquid in the second stage may not re-enter the counter-current wash zone, and wherein the second stage includes a second recycle loop through which the temperature and/or pH of the second stage may be adjusted; and (vi) an exit stream adapted to receive a soup-like consistency of cellulosic material after treatment in the second stage, wherein the exit stream exits the bottom of the vessel. To ensure no material from the second stage enters the counter-current wash zone, a pass-through zone may be located physically between the wash zone and the second stage. This pass-through zone allows the material to merely move through the zone.

In an aspect, an embodiment generally relates to a method for extracting $C_5$ (pentose) and/or $C_6$ (hexose and hemicellulose) from a slurry of cellulosic material comprising cellulose, water, and optionally acid, the method comprising the steps of: feeding the slurry of cellulosic material comprising cellulose, water, and optionally acid to a first stage via an inlet at a top of a vessel; exposing the slurry in the first stage to a temperature between 130° C. and 190° C. for a period of time ranging between 10 minutes and 120 minutes; extracting liquid comprising pentose and/or hexose from the slurry in the first stage; feeding the slurry to a counter-current wash stage; feeding water to a counter-current wash stage via a first recycle loop; exposing the slurry in a counter-current wash stage to a temperature between 100° C. and 170° C. for a period of time ranging between 30 minutes and 120 minutes; passing the material through a pass-through zone; feeding the slurry to a second stage; exposing the slurry in the second stage to a temperature between 150° C. and 190° C. for a period of time ranging between 30 minutes and 240 minutes while lowering the pH, wherein the slurry in the second stage obtains a soup-like consistency; feeding acid and/or base to the second stage via a second recycle loop, wherein the second recycle loop passes through a heat exchanger; removing the slurry from the.

BRIEF DESCRIPTION OF THE DRAWINGS

FIG. 1 is an illustrative schematic diagram of a reactor vessel in accordance with an embodiment.

DETAILED DESCRIPTION OF THE INVENTION

In certain aspects, the present invention generally relates to a method and apparatus to dissolve $C_5$ and $C_6$ sugars from cellulosic material. Preferably, the traditional Kraft cooking process is not used to produce dissolved $C_5$ sugars. $C_5$ sugars include, for example, xylose, arabinose and other pentoses. $C_6$ sugars include, for example, glucose, mannose, other hexoses and other hemicellulose compounds.

In an aspect, the cellulosic material may be hydrolyzed in a multiple-step process within a single vessel. Cellulosic material may be fed to the top of a vessel (e.g., a cylindrical vessel) in a slurry. The cellulosic slurry may be fed using a pump, hydrostatic pressure, or any other method of delivering the slurry to a top of a vessel.

The pH of the slurry containing cellulosic material may be between 0 and 7. In certain embodiments, the slurry may contain water or a mixture of water and acid to achieve the desired pH. In certain embodiments, the slurry of material upon entering the vessel the material is heated to a temperature of between 130° C. and 190° C. (and all subranges therebetween) and has a liquid to wood ratio of between 1 to 1 and 1 to 10 (and all subranges therebetween).

In certain embodiments, there may be a hydrolysis stage with a short or very short duration or residence time where the temperature is over 170° C. This short time period may facilitate dissolving $C_5$ sugars while inhibiting dissolving lignin. In such a hydrolysis stage, it is believed that the linkage or bond between the hemicellulose and the lignin is broken (thus yielding the $C_5$ sugars). It is believed that the lignin does not dissolve because the location of the lignin in the cellulosic material may require a longer treatment or exposure time to dissolve the lignin.

According to certain embodiments, the cellulosic material is held in a first stage of hydrolysis for a short time and at a high temperature. In certain embodiments, the time period may last between 10 and 120 minutes (and all subranges therebetween). In certain embodiments, the temperature may be between 130 and 190° C. (and all subranges therebetween) and preferably above 170° C. if acid is not added to the slurry. If acid is added to the slurry, the temperature in this first stage may be lowered, but would be above 130° C. In this stage, it is believed that the $C_5$ sugars are formed by breaking the linkage between the hemicellulose and lignin. After the short, high temperature hydrolysis stage, liquid containing the $C_5$ sugars is extracted and sent to further process units for processing, such as separation, purification, etc.

Following the extraction of the $C_5$ sugar rich stream produced from the first hydrolysis stage, a counter current wash zone may be provided. In this wash zone, relatively cool water (e.g., below 170° C.) may added to a circulation loop to allow for cooling of the cellulosic material. In this counter-current wash stage the hot cellulosic material may be cooled to facilitate diffusion out of the dissolved hemicellulose, thus leaving primarily the lignin and cellulose in the mass of cellulosic material. This counter-current wash may occur for a period between 30 minutes and 2 hours (and all subranges therebetween) and at temperature between 100° C. and 170° C. (and all subranges therebetween), preferably at a temperature of 140° C. to 160° C. (and all subranges therebetween).

Following a counter-current wash stage may be a section of the vessel where the cellulosic material passes through without the addition of liquid. A second hydrolysis stage is located below the pass through section of the vessel. In preferred embodiments, essentially no liquid from the second hydrolysis stage is permitted to flow upward through the pass-through section of the vessel.

A circulation loop may be located at the end of the pass-through section of the vessel. This loop may consist of a screen to facilitate the removal of liquid from the vessel. If desired, acid may be added to lower the pH of the liquid, and/or a heater may be provided to allow for the increase in the temperature to above 180° C. (and preferably 180° C. to 190° C.) if necessary.

In the second hydrolysis stage, the cellulosic material may partially or fully dissolve. The residence time or duration of the second stage may be between 30 minutes and 4 hours (and all subranges therebetween). At this point, there may exist a continuous breakdown of the cellulosic material to such a point that the material is a "soup" or colloidal suspension of lignin, carbohydrates, and dissolved fibers. In this "soup," biomass particles may not be visible.

This process may facilitate the control of the biomass in the top part of the vessel independent of the bottom section of the vessel and independent of what is removed from the bottom of the vessel. Due to the "soup" consistency in the bottom, the top of the vessel may be easier to control.

The "soup" may then be discharged from the bottom of the vessel for processing downstream, where it may be separated into its various components (e.g., valuable products).

FIG. 1 schematically illustrates an embodiment including a single vessel 100. A slurry of cellulosic material enters the top of vessel 100 via line 110. In preferred embodiments, the cellulosic slurry includes chips and/or pulp, water, and optionally acid. In other embodiments, further additives may be present in the cellulosic slurry, e.g., to facilitate the extraction of $C_5$ and/or $C_6$ sugars from the cellulosic material.

After entering the vessel 100, the cellulosic slurry enters a first stage 120 where it is exposed to a temperature between 130° C. to 190° C. for a period of time between 30 to 120 minutes. After this stage, a liquid containing $C_5$ sugars and/or $C_6$ sugars is extracted via screen 122 and line 124.

The hot cellulosic slurry then enters a counter-current wash zone 130, where it dwells for a period of time between 30 minutes and 2 hours at a temperature between 100° C. to 170° C. Counter-current wash zone also includes a recycle loop comprising extraction screen 132, lines 134 and 140, pump 138, and line 136 (through which relatively cool water may be added to the recycle loop so as to cool the cellulosic material in the counter-current wash zone).

After this counter-current wash zone, the cellulosic material enters a second hydrolysis stage 142. Preferably, no liquid or material from the second stage 142 enters counter-current wash zone 130. Pass-through zone 160 may be between counter-current wash zone 130 and second stage 142, and pass-through zone 160 and/or screen 132 may prevent material from second stage 142 from entering counter-current wash zone 130. This second stage 142 includes a recycle loop comprising extraction screen 144, lines 146 and 154, pump 150, heat exchanger 152 (though which the temperature of the second stage may be adjusted), and line 148 (through which acid/base may be added to adjust the pH of the second stage). The temperature of the second stage may be above 150° C. (e.g., above 170° C. or between 180° C. and 190° C.). The residence time of the second stage may be between 30 minutes and 240 minutes. The cellulosic material may have a soup-like consistency and may be removed from vessel 100 through optional stage 156 and line 158 and exposed to further downstream processing. Preferably, the sole extraction of dissolved $C_5$ (pentose) and $C_6$ (hexose) in liquid occurs once: after the first hydrolysis stage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for extracting $C_5$ sugars including pentose or $C_6$ sugars including hexose from a slurry of cellulosic material comprising cellulose, water, and optionally acid, the method comprising the steps of:

feeding the slurry of cellulosic material comprising cellulose, water, and optionally acid to a first stage via an inlet at a top of a vessel;

exposing the slurry in the first stage to a first temperature between 130° C. and 190° C. for a first period of time ranging between 10 minutes and 120 minutes;

extracting liquid comprising pentose or hexose from the slurry in the first stage;

passing the slurry to a counter-current wash stage;

feeding water to the counter-current wash stage via a first recycle loop;

exposing the slurry in the counter-current wash stage to a second temperature between 100° C. and 170° C. for a second period of time ranging between 30 minutes and 120 minutes;

passing the material through a pass-through zone;

passing the slurry to a second stage;

exposing the slurry in the second stage to a third temperature between 150° C. and 190° C. for a third period of time ranging between 30 minutes and 240 minutes while lowering the pH, wherein the slurry in the second stage obtains a soup-like consistency;

feeding acid or base to the second stage via a second recycle loop, wherein the second recycle loop passes through a heat exchanger; and removing the slurry from the vessel, wherein the slurry comprises lignin.

2. The method according to claim 1, wherein the pass-through zone prevents material from the second stage from entering the wash zone.

3. The method according to claim 1, wherein the second temperature is between 140° C. and 160° C.

4. The method according to claim 1, wherein the slurry comprises acid and the first temperature is between 130° C. and 170° C.

5. The method according to claim 1, wherein the slurry does not comprise acid and the first temperature is between 170° C. and 190° C.

6. The method according to claim 1, wherein the second temperature is between 140° C. and 160° C.

7. The method according to claim 1, wherein the third temperature is between 180° C. and 190° C.

* * * * *